US005701819A

United States Patent [19]

Stephan

[11] Patent Number: 5,701,819

[45] Date of Patent: Dec. 30, 1997

[54] SHEET TRANSFER DRUM

[75] Inventor: Günter Stephan, Wiesloch-Bayertal, Germany

[73] Assignee: Heidelberger Druckmaschinen AG, Heidelberg, Germany

[21] Appl. No.: 522,734

[22] Filed: Sep. 1, 1995

[30] Foreign Application Priority Data

Sep. 5, 1994 [DE] Germany ..... 44 31 548.1
Nov. 28, 1994 [DE] Germany ..... 44 42 301.2

[51] Int. Cl.[6] ..... B41F 1/30

[52] U.S. Cl. ..... 101/409; 101/408; 271/277

[58] Field of Search ..... 101/409, 410, 101/408, 407.1, 416.1, 246; 271/277, 314, 82, 85, 204–206

[56] References Cited

U.S. PATENT DOCUMENTS

| | | | |
|---|---|---|---|
| 2,933,039 | 4/1960 | Claybourn et al. | 101/183 |
| 4,120,492 | 10/1978 | Cerny | 271/82 |
| 4,202,268 | 5/1980 | Becker et al. | 101/409 |
| 4,303,014 | 12/1981 | Becker et al. | 101/409 |
| 4,667,952 | 5/1987 | Jeschke et al. | 271/277 |
| 4,815,379 | 3/1989 | Becker et al. | 101/246 |
| 5,172,634 | 12/1992 | Iwamoto | 271/277 |

FOREIGN PATENT DOCUMENTS

| | | |
|---|---|---|
| 35 36 442 | 5/1986 | Germany . |
| 35 36 536 | 6/1986 | Germany . |
| 36 02 084 | 12/1989 | Germany . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Sheet transfer drum mounted between printing units within side walls of a rotary printing press includes two gripper bars arranged symmetrically on a circumference of the sheet transfer drum so as to be located diametrically opposite one another on a y-axis of the sheet transfer drum; a drum body core formed with side surfaces extending between the gripper bars over the entire length of the sheet transfer drum within the circumference of the sheet transfer drum and having a convex curvature with a curvature gradient which is largest in the region of the x-axis and diminishes continuously towards the gripper bars.

7 Claims, 3 Drawing Sheets

SHEET TRANSFER DRUM

BACKGROUND OF THE INVENTION

1. Field of the Invention

The invention relates to a sheet transfer drum and, more particularly, to such a sheet transfer drum mounted between printing units within side walls of a rotary printing press.

2. Description of Related Art including information disclosed under 37 CFR 1.92–1.99

Due to the varied behavior of cardboard or pasteboard, on the one hand, and thin paper, on the other hand, while they are being transported, respective special machines and standard printing presses with special devices adapted to the respective requirements have become established in the marketplace.

German Patent 36 02 084 discloses a sheet transfer drum having a diameter three times as large as that of a conventional plate cylinder. This drum is constructed by forming a free space in a full cylinder body so as to allow for necessary moving space for printing material which is resistant to bending. Thus, an almost triangular contour remains. This contour has advantages which are described in this German patent. For the processing of very thin papers, however, the drum can be supplemented with sheet-carrying elements so as to form a full cylinder body. The surface of this full cylinder body can also be provided with an anti-smear layer.

Like or similar associations apply to the single-revolution drum disclosed in U.S. Pat. No. 2,933,039. However, there remains therein no sufficiently rigid core body as would be necessary for the presently conventional number of printing units and the driving power connected therewith.

German Patents 35 36 536 and 35 36 442 describe further improvements with hinged segments which are supposed to permit adjustment to the type of printing material being processed. Protection against smearing must be provided, however, by means of blowing air. Such devices can process only a small range of printing materials. For cardboards, anti-smear protection must again be sought after by a strong application of blowing or blast air, with the very high installation and operating costs incident therewith. Such solutions are not suitable, however, for especially stiff materials.

The adjustment of segments to match or accommodate the respective type of printing material is extremely time-consuming if not actually impossible for the operator, in view of the inaccessibility to the segments in the press and the many adjustment parameters.

SUMMARY OF THE INVENTION

It is accordingly an object of the invention to provide a sheet transfer drum with a double-size diameter, i.e., having twice the diameter of a conventional plate cylinder, for example, which is capable of smear-free processing of all types of printing material available in the marketplace, e.g., cardboards and papers, without requiring any costly make-ready time.

With the foregoing and other objects in view, there is provided, in accordance with the invention, a sheet transfer drum mounted between printing units within side walls of a rotary printing press, comprising two gripper bars arranged symmetrically on a circumference of the sheet transfer drum so as to be located diametrically opposite one another on a y-axis of the sheet transfer drum; a drum body core formed with side surfaces extending between the gripper bars over the entire length of the sheet transfer drum within the circumference of the sheet transfer drum and having a convex curvature with a curvature gradient which is largest in the region of the x-axis and diminishes continuously towards the gripper bars.

In accordance with another feature of the invention, the side surfaces have a central diameter forming a ratio with a theoretic drum diameter within a range of 1:2 to 1.35:2, and having surface portions extending from the central diameter rectilinearly and inwardly inclined towards the y-axis.

In accordance with a further feature of the invention, the drum body core has guide surfaces extending over the length of the drum body core and connected to the two gripper bars.

In accordance with an added feature of the invention, the drum body core has support surfaces on both sides thereof, and sheet guide plates formed as guide surfaces fastened to the support surfaces, the guide surfaces being inclined inwardly starting from the central diameter.

In accordance with an additional feature of the invention, the sheet guide plates are adjustably disposed in a direction towards the circumference of the sheet transfer drum and are mounted in swivel bearings in the vicinity of the gripper bars.

In accordance with yet another feature of the invention, the side surfaces are rounded off inwardly at respective ends thereof in the vicinity of the gripper bars.

In accordance with a concomitant feature of the invention, the guide surfaces and the sheet guide plates, respectively, are rounded off inwardly at respective ends thereof in the vicinity of the gripper bars.

The contour defined hereinabove permits a flutter-free and smear-free transfer of very thin sheets or stiff sheets from the preceding impression cylinder. A transported sheet is moved over the sheet guide plate below the transfer drum in a manner that only the trailing edge of the sheet slides along the surface of the sheet guide plate. Also, during the take-over of the sheet by the following impression cylinder, only the trailing edge of the sheet is in contact with the guide surface of the sheet transfer drum. Therefore, the sheet transfer drum according to the invention is suitable for all types of carton, i.e., cardboard or pasteboard or the like, and paper, not only in single-side or recto-printing but also in recto/verso or first-form and perfector printing.

In order to process printing material smear-free in accordance with the invention, the dynamic behavior thereof must be known. Accordingly, for an analysis thereof, the following parameters must be considered: bending or flexural stiffness of the printing material, weight per unit area, format, elasticity and plasticity of the printing material, diameter of the transfer drum, diameter of the impression cylinders, position of the transfer drum with respect to the impression cylinders, position of the blanket cylinders with respect to the impression cylinders, diameter of the blanket cylinders and the impression cylinders, production speed from the operating condition, pressure of the blanket cylinders, inking and dampening.

In considering the aforementioned parameters, the structural conditions of the press have to be taken into consideration, and the most unfavorable respective operating conditions for printing materials have to be selected as a basis. Of all of the parameters, however, the influence of bending or flexural stiffness, format and speed are of special significance.

Other features which are considered as characteristic for the invention are set forth in the appended claims.

Although the invention is illustrated and described herein as embodied in a sheet transfer drum, it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings, in which.

Figure 1:
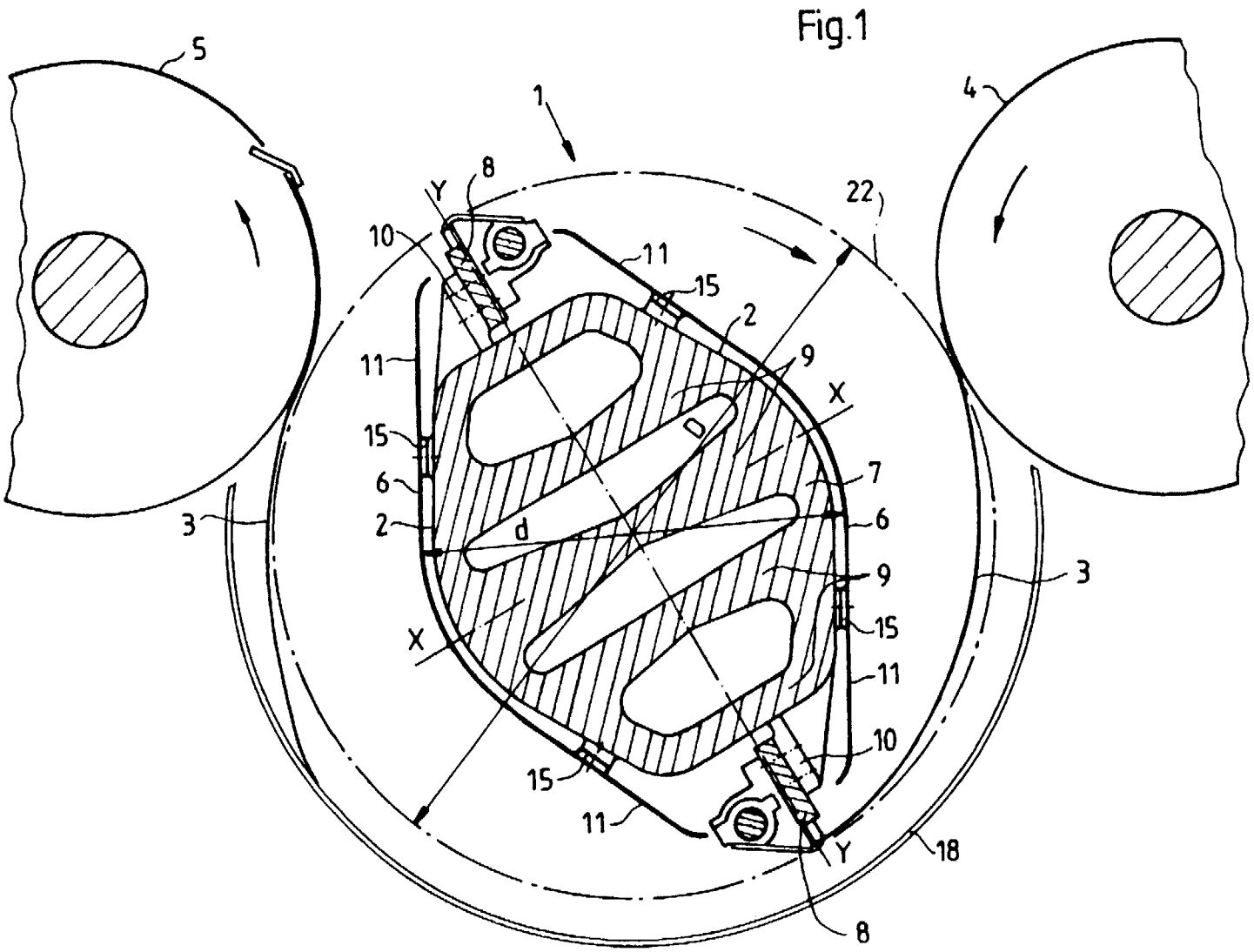
FIG. 1 is a diagrammatic cross-sectional view of a sheet transfer drum according to the invention located between impression cylinders of a rotary printing press.

Referring now to the drawings and, first, particularly to FIG. 1 thereof, there is shown therein the contours of a transfer drum 1 receiving sheets 3 to be transported from an impression cylinder 4 of one printing unit of a rotary printing press and transferring them to a succeeding impression cylinder 5 of a following printing unit. The contours of the transfer drum 1 are made up of two geometries or specially formed side surfaces 2, as shown in the figure. Above the side surfaces 2, sheet guide plates 6 are fastened to the drum body core 7, the shape of the sheet guide plates 6 matching or being adapted to the shape of the drum body core 7.

The construction of this embodiment of the transfer drum 1 according to the invention fulfills the following requirements: a nearly axially symmetrical rigidity (compared with the uniformity of a full cylinder with a channel or gap); an absolutely greater than three-fold rigidity about the weaker axis, compared with heretofore known sheet transfer drums; a bracing support of the trailing edge of stiff cardboard or pasteboard (for maximum format length and lowest production speed; thus, the most unfavorable situation), so that without the use of blowing or blast air from the outside, complete freedom from smearing is assured; no contact with the printed surface, neither with cardboard nor thin paper; and a blade effect, i.e., a conduction of air in such a manner that pressure is increased above the sheet, however, no turbulences get under the sheet when it is freely rotated out from the sheet guide plate.

Figure 2:
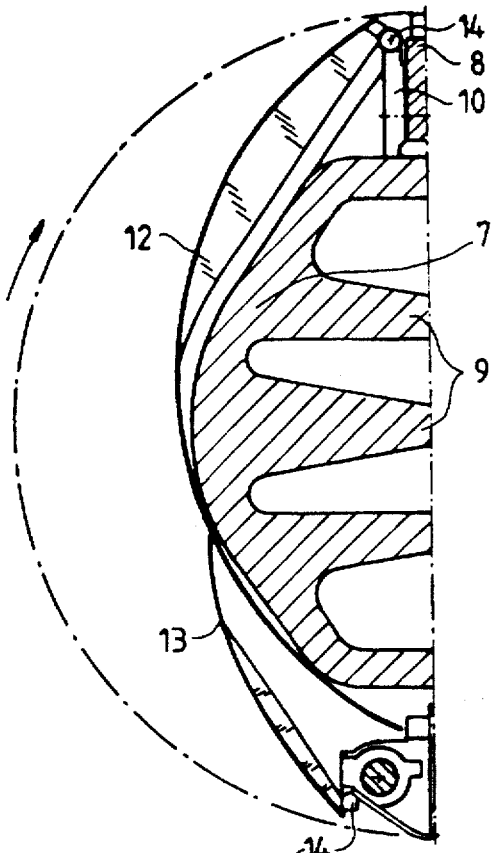
FIGS. 2 and 3 are respective cross-sectional half views of the sheet transfer drum modified for transporting thin papers.
Figure 3:
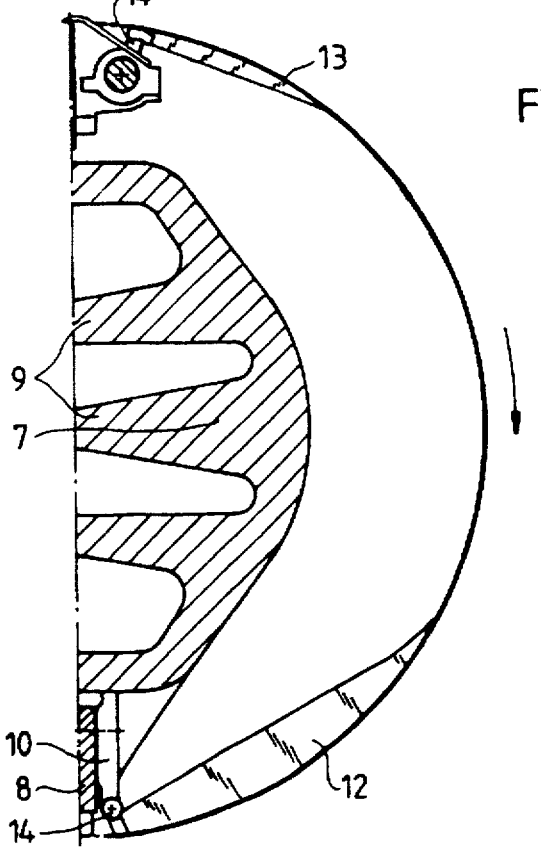

The sheet-transfer drum according to the invention is constructed as illustrated in detail in FIGS. 1, 2 or 3, namely:

The drum body core 7 is formed of a cast or forged part. In order to achieve the necessary rigidity, it is provided with a maximum inner circle diameter. Altogether, the drum body core has a nearly oval or ovoid shape with an abutment pad 10 connection for attaching gripper bars 8 on the y-axis. The axial symmetry for rigidity can also be attained by means of suitable ribbing 9. The side surfaces 2 of the drum body core 7 can be formed as guide surfaces.

In the embodiment shown in FIG. 1, a respective sheet guide plate 6 is provided on the side surfaces 2 of the drum body core 7. The sheet guide plate 6, to a marked extent, has the shape of the side surfaces 2 according to FIG. 1 and is fastened to support surfaces 15 at the drum body 7, so that a surface contour is created which is optimal for sheet guidance without diminishing the axial symmetry of the body-core rigidity. The sheet guide plates 6 are firmly screwed to the drum body core 7 and have a central diameter d, the ratio of which to a theoretical drum diameter D is within a range of 1:2 to 1.35:2. The sheet guide plates 6 are formed with guide surfaces 11 extending from the central diameter d and being inclined inwardly towards the y-axis and rounded-off inwardly at respective ends thereof in the vicinity of the gripper bars 8.

In a further embodiment shown in FIGS. 2 and 3, the sheet guide plates 12 and 13 can be arranged on the drum body core 7 so as to be adjustable to or match the respective printing material, the speed and the format. The adjustment of the sheet guide plates 12 and 13, which are mounted in swivel bearings 14 arranged in the vicinity of the gripper bars 8, from an inwardly swung position (note FIG. 2) to an outwardly swung position (note FIG. 3) is advantageously effected by a single actuating means, for example, a lifting cylinder or an actuating drive, the adjustment or adaptation to all parameters having an influence upon the sheet guidance, and the automation is considerably simplified by prescribing the thickness and format of the printing material.

Figure 4:
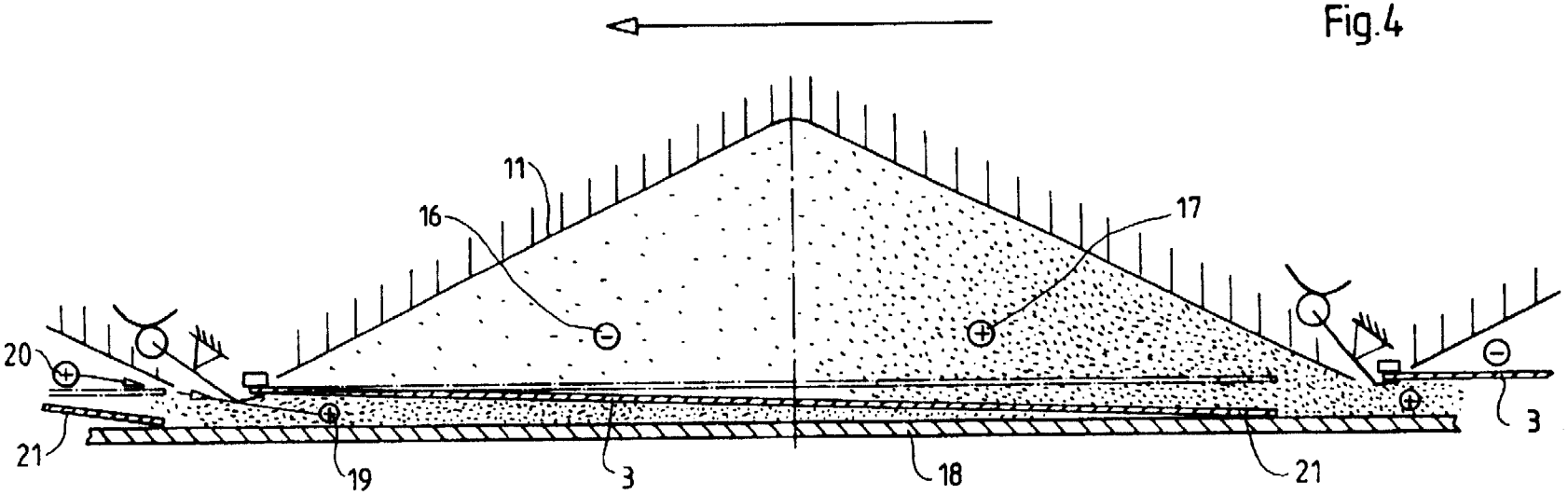
FIG. 4 is a much-enlarged fragmentary developed view of FIG. 1 illustrating the impeller-like blade action of the drum-core contour.

The blade or vane action of the drum contour is illustrated in FIG. 4. The construction of the contour geometry produced on the drum body core by guide surfaces of the drum body core or the sheet guide plates occurs when the drum is rotated, taking into consideration the pressure conditions and air turbulences, in addition to observing the aforementioned path of movement.

The drum rotation is known to effect the creation of a potential vortex field, similar to that of an cross-current or axial flow fan. In this regard, however, the significance lies in the relative rotational speed. Each blade or vane, which automatically comes into existence because the drum is not formed as a full cylinder, influences a transported sheet.

This interaction between guide surfaces and sheets results in the formation of a contour, so that each region of a sheet, from the leading edge to the trailing edge, is influenced with a respective effect. In this regard, a suction effect 16 in the leading or front part of the sheet 3 (extending outwardly from the drum center) is useful, in order to avoid surface contact with the guide plate 6. Furthermore, a suction effect in the transfer zone from the preceding impression cylinder 4 facilitates the loosening or detachment of especially thin papers from the impression cylinder. This underpressure or negative pressure effect is achieved due to the fact that the open or non-engaging cross-section between drum contour and guide plate 6 widens in a manner similar to a diffuser. This widening results from the rotation of the drum contour relative to the stationary air and the guide plate.

An overpressure 17 above the sheet end is useful in all zones of movement, in fact, during the transfer from the preceding impression cylinder, in order to prevent the sheet end from hanging down at lower speed and, in the case of thin papers, to prevent the sheet end from bending at high speeds, as well as to prevent the sheet end from whipping up in the case of thick cardboard or pasteboard. Furthermore, an overpressure 19 above the guide plate 18 is useful, in order to guide the sheet end and especially the cardboard or pasteboard end, respectively, on the guide plate 18. Finally, an overpressure 20 is advantageous in the transfer to the following impression cylinder, in order to keep the required free space of movement for stiff cardboard or pasteboard as narrow as possible.

This pressure effect develops in reverse to the suction effect by the narrowing of the cross section through or out of the rotation of the drum. Consequently, underpressure and overpressure support one another, as shown in the schematic and rectilinear development illustrated in FIG. 4.

From the leading sheet, the overpressure zone 17 now lying above the sheet 3 gets under the viewed sheet. The sheet 3, which is supported by the underpressure zone 16 in the diffuser region (widening) of the transfer drum 1, floats on this carrying or support air and is guided in suspension, that is, contact-free on both sides, which is especially important in recto/verso or first-form and perfector printing.

The sheet end 21, during its transport through the drum, is pressed against the guide plate 18 because of the overpressure effect 17. Due to the curvature of the guide plate, contact takes place only with the trailing edge, whereat, simultaneously, the separation of the overpressure zone from the underpressure zone is caused by the sheet.

When the transfer drum 1 rotates outside of the guide plate 18, the flow about the rotating vane or blade contour should be as free of vortex as possible. Therefore, the end portion or outlet of the guide surface 11 is rounded off at the level of the gripper bar and formed so as to define an obtuse angle with the main portion of the guide surface 11. Through the so-called Coanda-effect, the flow about the edge of the guide surface 11 of the sheet guide plate 6 takes place in a manner that the air flowing down from above the side surface and the sheet guide plate, respectively, does not get under the sheet 3 which has already been transferred and surrendered to the following impression cylinder 5. A high-blown lifting of the end of this sheet is thereby prevented.

As shown in FIG. 1, the cross section of the drum body core 7, the side surfaces 2 of which are formed as guide surfaces, is at its widest in the direction of the x-axis, but is at its narrowest, however, in the vicinity of the gripper bars. Nevertheless, this drum body core 7 is spaced the greatest distance away from the theoretical drum circumference line 22 in the region of the x-axis of the cross section.

I claim:

1. Sheet transfer drum mounted between printing units within side walls of a rotary printing press, comprising two gripper bars arranged symmetrically on a circumference of the sheet transfer drum so as to be located diametrically opposite one another on a y-axis of the sheet transfer drum; a drum body core formed with side surfaces extending between said gripper bars over the entire length of the sheet transfer drum within said circumference of the sheet transfer drum and having a convex curvature with a curvature gradient which is largest in the region of the x-axis and diminishes continuously towards said gripper bars.

2. Sheet transfer drum according to claim 1, wherein said side surfaces have a central diameter forming a ratio with a theoretic drum diameter within a range of 1:2 to 1.35:2, and having surface portions extending from said central diameter rectilinearly and inwardly inclined towards the y-axis.

3. Sheet transfer drum according to claim 1, wherein said drum body core has guide surfaces extending over the length of said drum body core and connected to said two gripper bars.

4. Sheet transfer drum according to claim 2, wherein said drum body core has support surfaces on both sides thereof, and sheet guide plates formed as guide surfaces fastened to said support surfaces, said guide surfaces being inclined inwardly starting from said central diameter.

5. Sheet transfer drum according to claim 4, wherein said sheet guide plates are adjustably disposed in a direction towards said circumference of the sheet transfer drum and are mounted in swivel bearings in the vicinity of said gripper bars.

6. Sheet transfer drum according to one of the claim 1, wherein said side surfaces are rounded off inwardly at respective ends thereof in the vicinity of said gripper bars.

7. Sheet transfer drum according to claim 4, wherein said guide surfaces and said sheet guide plates, respectively, are rounded off inwardly at respective ends thereof in the vicinity of said gripper bars.

* * * * *